US009905201B2

(12) United States Patent
Liu

(10) Patent No.: US 9,905,201 B2
(45) Date of Patent: Feb. 27, 2018

(54) DISPLAY CONTROL METHOD AND DEVICE FOR APPLICATION PROGRAM INTERFACE

(71) Applicant: MStar Semiconductor, Inc., Hsinchu Hsien (TW)

(72) Inventor: Xiao-Long Liu, Hsinchu Hsien (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 229 days.

(21) Appl. No.: 14/933,464

(22) Filed: Nov. 5, 2015

(65) Prior Publication Data

US 2016/0155411 A1 Jun. 2, 2016

(30) Foreign Application Priority Data

Nov. 28, 2014 (CN) ..... 2014 1 0706438

(51) Int. Cl.

| | |
|---|---|
| ***G09G 5/00*** | (2006.01) |
| ***G09G 5/391*** | (2006.01) |
| ***G09G 5/36*** | (2006.01) |

(52) U.S. Cl.

CPC ..... *G09G 5/391* (2013.01); *G09G 5/363* (2013.01); *G09G 2340/0407* (2013.01)

(58) Field of Classification Search

None

See application file for complete search history.

(56) References Cited

U.S. PATENT DOCUMENTS

2003/0081006 A1* 5/2003 Sheldon ..... G06F 3/0481 715/781

2007/0132787 A1* 6/2007 Ko ..... G06F 3/14 345/660

FOREIGN PATENT DOCUMENTS

| | | |
|---|---|---|
| CN | 101520755 | 9/2009 |
| CN | 102662616 | 9/2012 |
| CN | 102917273 | 2/2013 |
| CN | 103744595 | 4/2014 |
| CN | 104035664 | 9/2014 |

OTHER PUBLICATIONS

Taiwan Intellectual Property Office, Office Action dated Jan. 29, 2016.

State Intellectual Property Office of the People's Republic of China , "Office Action", dated Apr. 18, 2017.

* cited by examiner

*Primary Examiner* — Ryan R Yang

(74) *Attorney, Agent, or Firm* — WPAT, PC

(57) ABSTRACT

A display control method for an application program interface is provided. The method includes: determining an appropriate resolution corresponding to the application program to be executed from at least two selectable resolutions; determining configuration information according to the appropriate resolution; establishing a display window having a size equal to a size corresponding to the appropriate resolution according to the configuration information, and loading a resource file corresponding to the application program interface; and rendering the application program interface in the display window on the a display device according to the appropriate resolution and the resource file. Through the above method, the present invention is capable of selecting an appropriate resolution for displaying an application program interface.

13 Claims, 4 Drawing Sheets

DISPLAY CONTROL METHOD AND DEVICE FOR APPLICATION PROGRAM INTERFACE

This application claims the benefit of People's Republic of China application Serial No. 201410706438.1, filed Nov. 28, 2014, the subject matter of which is incorporated herein by reference.

BACKGROUND OF THE INVENTION

Field of the Invention

The invention relates in general to display processing technologies, and more particularly to a display control method and device for an application program interface.

Description of the Related Art

The current Android system supports devices having different monitor sizes and densities. For an application program, the Android system provides a unified development environment for correcting a user interface that an application interface displays on a monitor. Meanwhile, the Android system further provides an application interface program (API) that allows a user to control an application interface to have an appropriate monitor size and density, so as to provide an optimized user interface design for different monitor configurations. For example, a user interface of a tablet computer is different from a user interface of a cell phone.

The Android system is capable of controlling the scaling and size adjustment of a user interface that an application program provides to allow the application program to operate in devices having differently-sized monitors. Further, to maximize the optimization of an application program to adapt to different monitor sizes and densities, and to maximize user experiences of all devices to convince users that the application program interface is tailor designed for the current device instead of being simply stretched to fit the current device, the Android system, from version 1.6 and onwards, added the support for numerous resolutions. Thus, various resolutions can be appropriately matched, such that an application program interface can be displayed in all supported monitor configurations to provide most optimized user experiences.

Currently, the Android system provides good adaptation for devices of various resolutions. However, all applications on one device are activated using the same resolution. For a high-resolution device, if an application is not adapted to the resolution and the application program interface is still displayed in the high resolution, the application program interface is stretched and appears blurry. On the other hand, for certain application programs adapted to high resolutions, the application program interface are displayed in a low resolution to satisfy user operations, and are however displayed in a high resolution on high-resolution devices, leading to a waste in the rendering capability of a graphic processor.

SUMMARY OF THE INVENTION

The invention is directed to a display control method and device for an application program interface, so that an appropriate resolution can be selected for displaying an interface of an application program according to the application program.

According to a first aspect of the present invention, a display control method for an application program interface is provided. The display control method, for controlling and displaying the application program interface on a display device, includes: determining an appropriate resolution corresponding to an application program to be executed from at least two predetermined selectable resolutions; determining configuration information according to the appropriate resolution; establishing a display window having a size equal to a size corresponding to the appropriate resolution according to the configuration information and loading a resource file corresponding to the application program interface; and rendering the application program interface in the display window on the display device according to the appropriate resolution and the resource file.

According to another aspect of the present invention, a display control device for an application program interface is provided. The display control device, for controlling and displaying the application program interface on a display device, includes: a resolution determining unit, configured to determine an appropriate resolution corresponding to an application program interface to be executed from at least two predetermined selectable resolutions; a configuration information determining unit, configured to determine configuration information according to the appropriate resolution determined by the resolution determining unit; a display window establishing unit, configured to establish a display window having a size equal to a size corresponding to the appropriate resolution according to the configuration information and to load a resource file corresponding to the application program interface; and an interface rendering unit, configured to render the application program interface in the display window on the display device according to the appropriate resolution and the resource file.

Compared to conventional solutions, the present invention provides followed effects. In the present invention, an appropriate resolution is determined according to related information of an application program interface (e.g., an attribute of an application program interface) to be executed, a display window having a size equal to a size corresponding to the appropriate resolution is established according to configuration information corresponding to the appropriate resolution, and the application program interface is then rendered on the display window. Thus, the technical issue of blurring caused by stretching a low-resolution application program interface on a high-resolution device is prevented. Meanwhile, a lower and appropriate resolution is selected in a high-resolution device to display an application program interface having a lower resolution, thereby achieving a technical effect of saving resources of a graphic processor.

The above and other aspects of the invention will become better understood with regard to the following detailed description of the preferred but non-limiting embodiments. The following description is made with reference to the accompanying drawings.

DETAILED DESCRIPTION OF THE INVENTION

To better explain technical contents, structural characteristics, objects and effects of the present invention, details of the present invention are given in the embodiments with the accompany drawings below.

Figure 1:
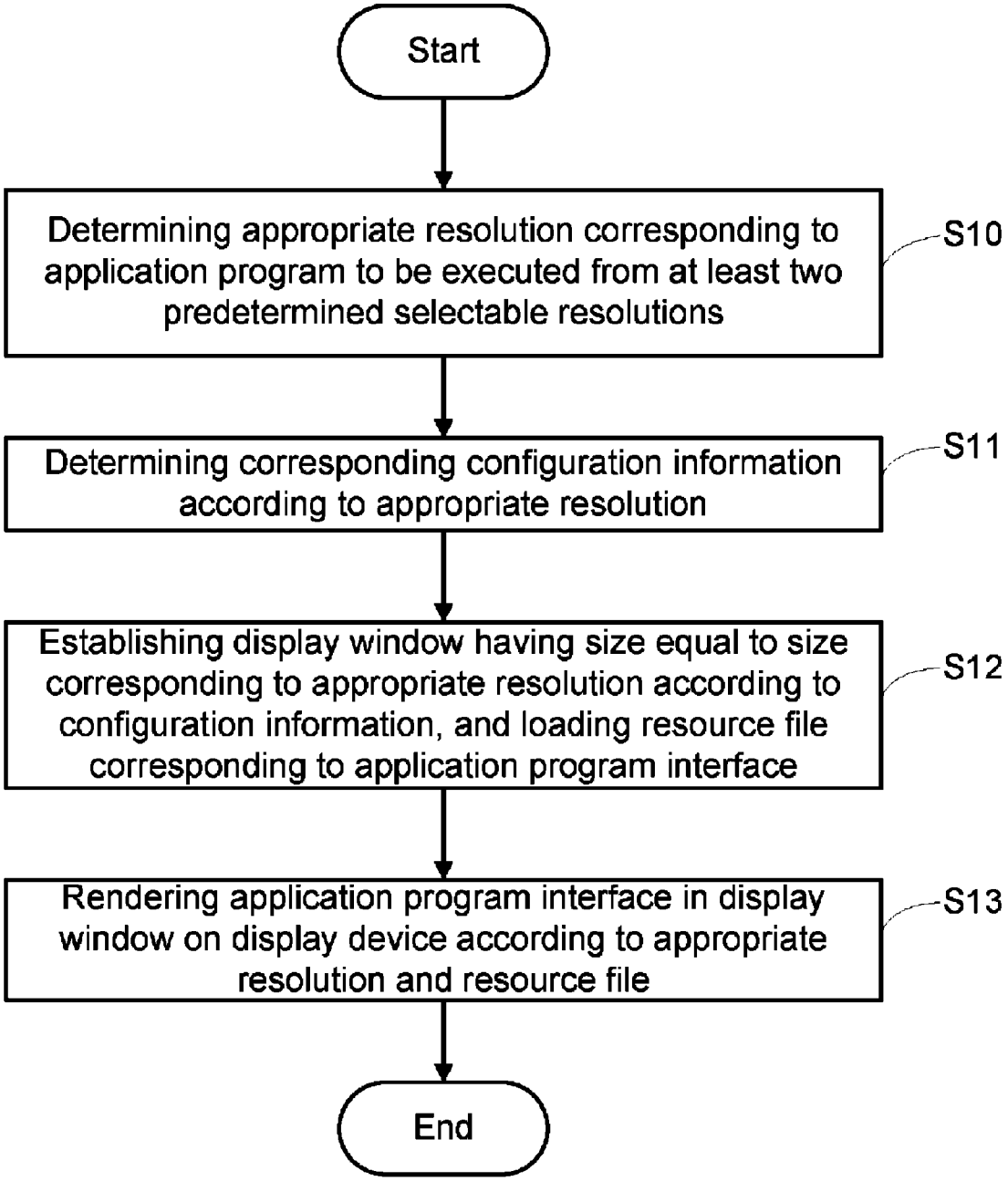
FIG. 1 is a flowchart of a display control method for an application interface program according to a first embodiment of the present invention.

FIG. 1 shows a flowchart of a display control method for an application program interface according to a first embodiment of the present invention. The display control method is for controlling and displaying an application program interface on a display device. The display control method for an application program interface according to the first embodiment includes following steps.

In step S10, an appropriate resolution corresponding to an application program to be executed is determined from at least two selectable resolutions. For example but not limited to, the appropriate resolution is defined by a user or defined by an application program, or is generated by other means.

The at least selectable resolutions are predetermined in the display device, and the application program having different functions is also pre-installed on the display device. For example, the at least two resolutions may be 3840×2160, 1920×1080 and 960×540.

In step S11, configuration information is determined according to the appropriate resolution.

For example, the configuration information includes a monitor resolution, a monitor size and horizontal and vertical monitor settings of the display device.

In step S12, a display window having a size equal to a size corresponding to the appropriate resolution is established, and a resource file corresponding to the application program interface is loaded.

The size of the established display window established is the equal to the size of the appropriate resolution, and corresponds to page contents of the application program interface to be rendered and rendered. For example, when the resolution is 3840×2160, the size of the established display window is also 3840×2160; when the resolution is 1920×1080, the size of the established display window is also 1920×1080.

In a system application, e.g., an Android application, resource files corresponding to different resolutions are stored in a resource folder, such that an application package file (APK) of the application program can be used for multiple monitors having different resolutions. Thus, when the application program is executed, the Android system traverses through all of the resource files, and filters out inappropriate entry files according to configuration information. For example, for a resolution of 1920×1080, resources exceeding such resolution are filtered out. The resource files remaining after the filtering process are matched to identify the most appropriate entry file, and the resource file in the corresponding resource folder is loaded.

In step S13, the application program interface is rendered in the display window on the display device according to the appropriate resolution and the resource file.

Figure 2:
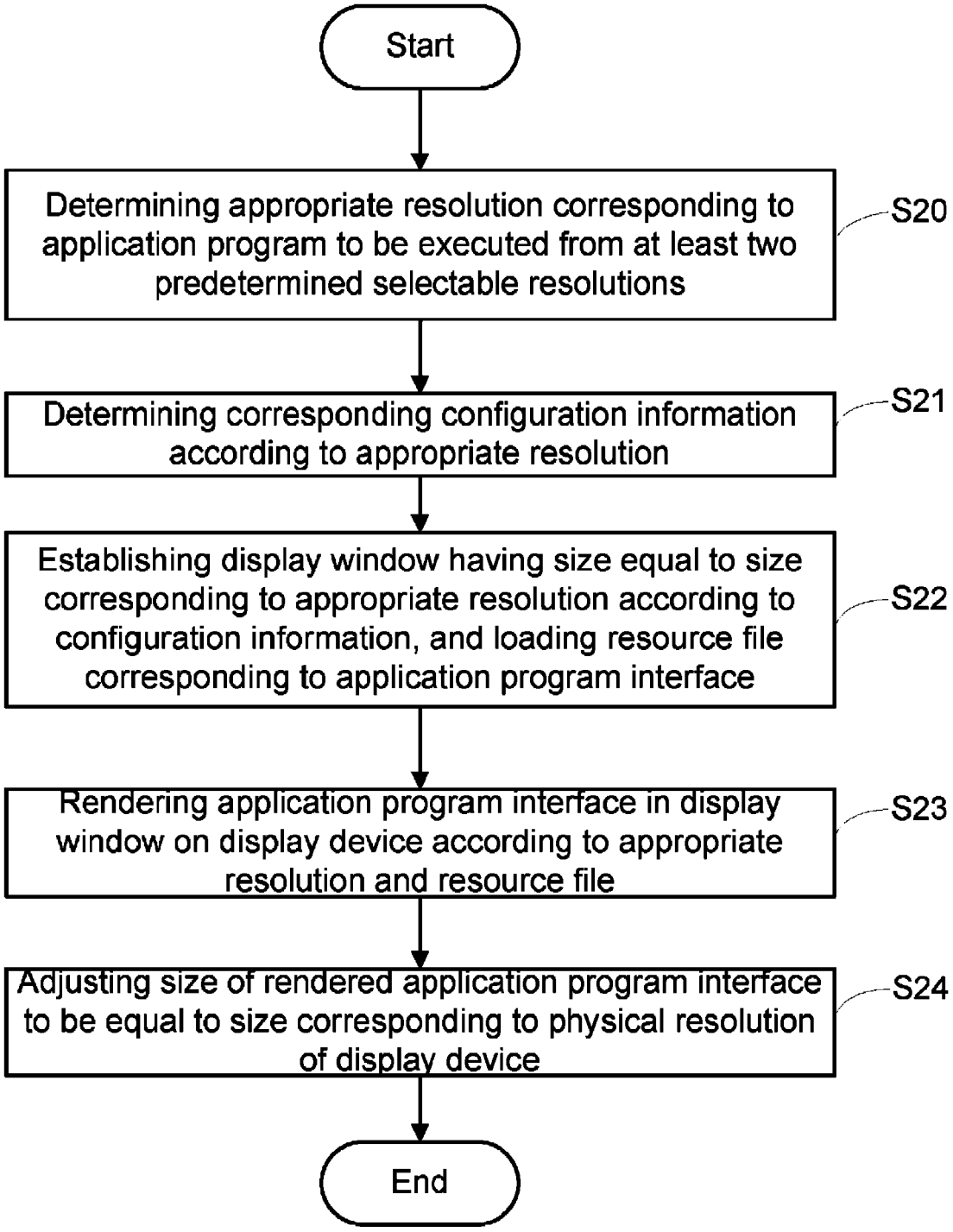
FIG. 2 is a flowchart of a display control method for an application interface program according to a second embodiment of the present invention.

FIG. 2 shows a flowchart of a display control method for an application program interface according to a second embodiment of the present invention. Referring to FIG. 2, a process of the display control method for an application program interface according to the embodiment includes following steps.

In step S20, determining an appropriate resolution corresponding to an application program to be executed from at least two predetermined selectable resolutions.

Principles of defining an appropriate resolution corresponding to an application program interface in advance are given in detail below.

In the embodiment, an appropriate resolution corresponding to an attribute of the application program interface is set in advance, with the attribute being identifiable to the system, so as to determine the appropriate resolution for the application program interface according to the attribute of the application program to be executed. The attribute of the application program interface may be identified according to a function to be performed. For example, the appropriate resolution of an application program interface with an attribute as a video player is set to 3840×2160, the appropriate resolution for an application program interface with an attribute as a drawing tool is set to 1920×1080, and the appropriate resolution for an application program interface with an attribute as a calculator is set to 960×540.

In another embodiment, a white list that records a list of application programs having an appropriate resolution as a predetermined resolution is established, and it is determined whether the application program to be executed is in the white list. When it is determined that the application program is in the white list, it is determined that the appropriate resolution of the application program interface is the predetermined resolution. When it is determined that the application program is not in the white list, it is determined that the appropriate resolution of the application program interface is a default resolution of the application program interface. For example, the predetermined resolution is selected from at least two predetermined selectable resolutions, and the default resolution may be a physical resolution of the display device or a predetermined resolution smaller than the physical resolution of the display device. For example, the white list records following contents: the appropriate resolution is 1920×1080, and the application list includes YouTube and Flickr. When it is determined that the application program to be executed is in the white list, it is determined that the appropriate resolution of the application program interface is 1920×1080. When it is determined that the application program is not in the white list, it is determined that the appropriate resolution of the application program is the default resolution of the application program interface, e.g., 3840×2160.

In step S21, corresponding configuration is determined according to the appropriate resolution.

In step S22, a display window having a size equal to a size corresponding to the appropriate resolution is established, and a resource file corresponding to the application interface is loaded.

The established display window has a size equal to the size of the appropriate resolution, and is for rendering and rendering page contents of the application program interface. For example, when the resolution is 3840×2160, the size of the established display window is also 3840×2160; when the resolution is 1920×1080, the size of the established display window is also 1920×1080.

In step S23, the application program interface is rendered in the display window on the display device according to the appropriate resolution and the loaded resource file.

Figure 3:
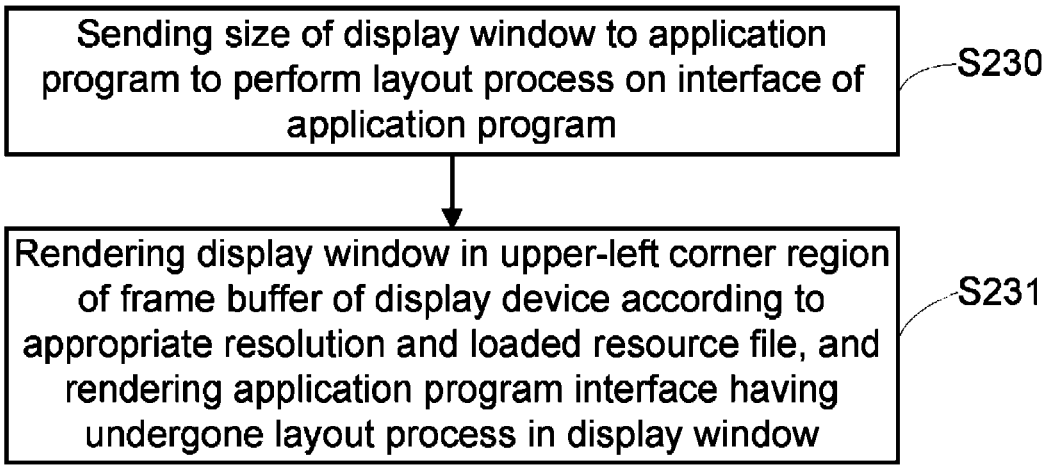
FIG. 3 is a flowchart of rendering an application interface program in an established display window according to an embodiment of the present invention.

FIG. 3 shows a flowchart of a process for rendering an application program interface in an established display window according to an embodiment of the present invention. In the embodiment, the appropriate resolution is smaller than the physical resolution of the display device. The process for rendering an application program interface in an established display window according to the embodiment includes following steps.

In sub-step S230, the size of the display window is sent to the application program to perform a layout process on the application program interface.

In sub-step S231, the display window is rendered in an upper-left corner region of a frame buffer of the display device according to the appropriate resolution and the loaded resource file, and a an Android-type application program interface having undergone the layout process is rendered in the display window.

Figure 4:
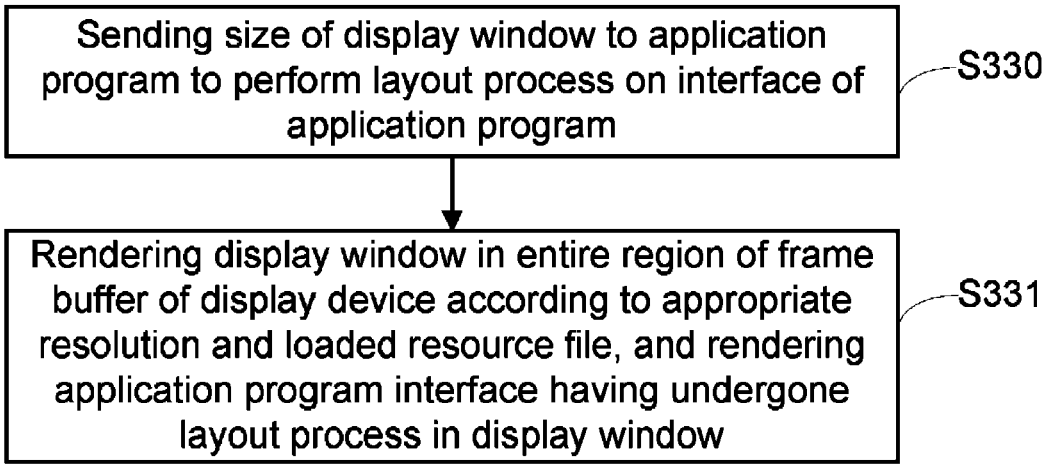
FIG. 4 is a flowchart of rendering an application interface program in an established display window according to another embodiment of the present invention.

FIG. 4 shows a flowchart of a process for rendering an application program interface in an established display window according to another embodiment of the present invention. In the embodiment, the appropriate resolution is equal to the physical resolution of the display device. The process for rendering an application program interface in an established display window on a display device according to the embodiment includes following steps.

In sub-step S330, the size of the display window is sent to the application program to perform a layout process on the application program interface.

In sub-step S331, the display window is rendered in an entire region of a frame buffer according to the appropriate resolution and the loaded resource file, and an Android-type application program interface having undergone the layout process is rendered in the display window.

In step S24, the size of the rendered application program interface is adjusted to be equal to the size corresponding to the physical resolution of the display device.

More specifically, after the display window is rendered in the upper-left corner region or the entire region of the frame buffer, a corresponding transform matrix is calculated according to the physical resolution to stretch the rendered image to the appropriate monitor size.

Figure 5:
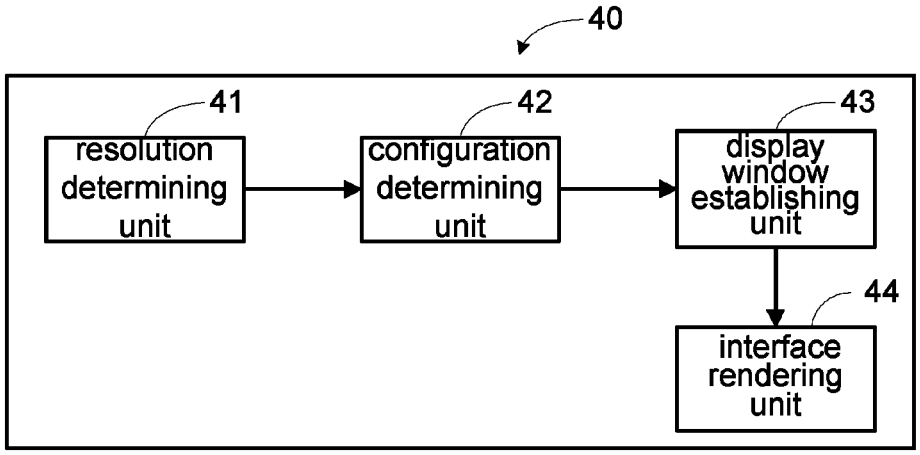
FIG. 5 is a schematic diagram of a display control device for an application program interface according to the first embodiment of the present invention.

FIG. 5 shows a schematic diagram of a display control device for an application program interface according to the first embodiment of the present invention. A device 40 includes a resolution determining unit 41, a configuration information determining unit 42, a display window establishing unit 43 and an interface rendering unit 44. The device 40 controls and displays an application program interface on a display device.

The resolution determining unit 41 determines an appropriate resolution corresponding to an application program to be executed from at least two predetermined selectable resolutions. For example but not limited to, the appropriate resolution is defined by a user or defined by an application program, or is generated by other means.

The configuration information determining unit 42 determines configuration information according to the appropriate resolution determined by the resolution determining unit 41. For example, the configuration information includes a monitor resolution, a monitor size and horizontal and vertical monitor settings of the display device.

The display window establishing unit 43 establishes display window having a size equal to a size corresponding to the appropriate resolution determined by the configuration information determining unit 42, and loads a resource file corresponding to the application program interface.

The interface rendering unit 44 renders the application program interface in the display window on the display device according to the appropriate resolution and the resource file.

Figure 6:
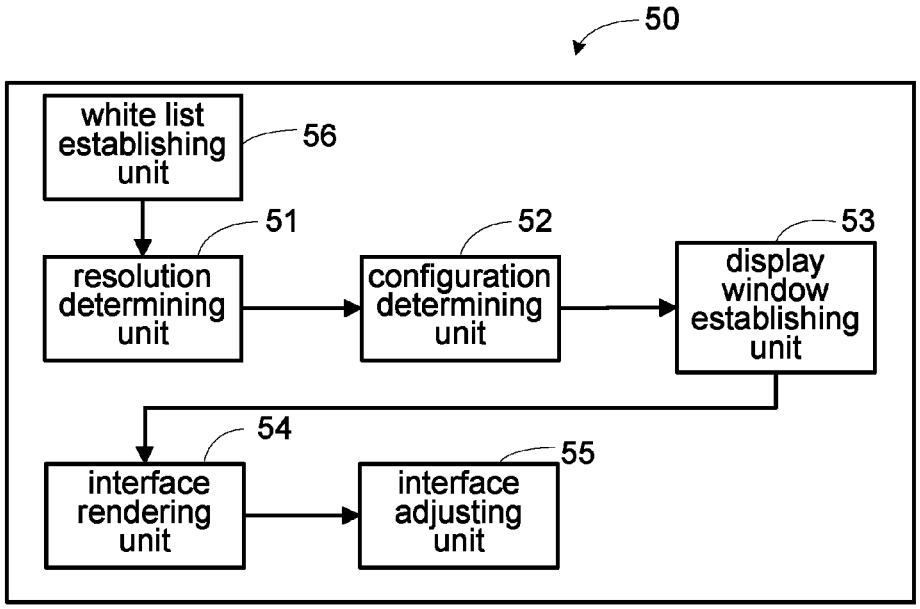
FIG. 6 is a schematic diagram of a display control device for an application program interface according to the second embodiment of the present invention.

FIG. 6 shows a schematic diagram of a display control device for an application program interface according to the second embodiment of the present invention. The device includes a resolution determining unit 51, a configuration information determining unit 52, a display window establishing unit 53, an interface rendering unit 54 and an interface adjusting unit 55. The device controls and displays an application program interface on the display device.

The resolution determining unit 41 determines an appropriate resolution corresponding to an application program interface to be executed from at least two predetermined selectable resolutions. For example but not limited to, the appropriate resolution is defined by a user or defined by an application program interface, or is generated by other means. In this embodiment, the resolution determining unit 51 sets the appropriate resolution corresponding to an attribute of the application program interface in advance, with the attribute being identifiable to a system, and determines the appropriate resolution for the application program interface according to the attribute of the application program to be executed. The attribute of the application program is identifiable according to the function to be performed, or identifiable according to the name of the application program. In another embodiment, the device 50 further includes a white list establishing unit 56, which is configured to record a list of application programs having an appropriate resolution as a predetermined resolution. The resolution determining unit 51 determines whether the application program to be executed is in the white list. When it is determined that the application program is in the white list, the resolution determining unit 51 determines that the appropriate resolution of the application program interface is the predetermined resolution. When it is determined that the application program is not in the white list, the resolution determining unit 51 that the appropriate resolution of the application program interface is a default resolution of the application program interface. For example, the predetermined resolution is selected from at least two predetermined selectable resolutions, and the default resolution may be a physical resolution of the display device or a predetermined resolution smaller than the physical resolution of the display device.

The configuration information determining unit 52 determines configuration information according to the appropriate resolution determined by the resolution determining unit 51. For example, the configuration information includes a monitor resolution, a monitor size and horizontal and vertical monitor settings of the display device.

The display window establishing unit 53 establishes display window having a size equal to a size corresponding to the appropriate resolution determined by the configuration information determining unit 52, and loads a resource file corresponding to the application program interface.

The interface rendering unit 54 renders the application program interface in the display window on the display device according to the appropriate resolution and the resource file. In the embodiment, the appropriate resolution is smaller than the physical resolution. More specifically, to renders the application program interface by the interface rendering unit 54, the interface rendering unit 54 sends the size of the display window to the application program to perform a layout process on the application program interface, renders the display window in an upper-left corner region of a frame buffer of the display device according to the appropriate resolution and the loaded resource file, and renders the application program interface having undergone the layout process in the display window. In another embodiment, the appropriate resolution is equal to the physical resolution. More specifically, to render the application program in the display window by the interface rendering unit 54, the interface rendering unit 54 sends the size of the display window to the application program to perform a layout process on the application program interface, renders the display window in an entire frame buffer of the display device according to the appropriate resolution and the loaded resource file, and renders the application program interface having undergone the layout process in the display window.

The interface adjusting unit 55 adjusts the size of the application program interface rendered by the interface rendering unit 54 to be equal to the size corresponding to the physical resolution. More specifically, after the display window is rendered in the upper-left corner region or the entire region of the frame buffer, the interface adjusting unit 55 calculates a transform matrix according to the physical resolution of the display device to stretch the rendered image to adapt to the monitor size.

An example of activating an application program in the Android system is given to explain the present invention.

When an application program to be executed is determined, an activity corresponding to the application program is correspondingly established, and ActivityManagerService (AMS) determines the appropriate resolution corresponding to the application program to be executed from at least two predetermined selectable resolutions according the established activity.

In the embodiment, the appropriate resolution corresponding to an attribute of the application program is set in advance, with the attribute being identifiable to the system, and AMS determines the appropriate resolution for the application program interface according to the attribute of the application program to be executed. In another embodiment, a white list that records a list of application programs having an appropriate resolution as a predetermined resolution is established, and AMS determines whether the application program to be executed is in the white list to determine the appropriate resolution of the application program interface. In another embodiment, a white list that records a list of application programs having an appropriate resolution as a predetermined resolution is established, and AMS determines whether the application program to be executed is in the white list. When it is determined that the application program is in the white list, it is determined that the appropriate resolution of the application program interface is the predetermined resolution. When it is determined that the application program is not in the white list, it is determined that the appropriate resolution of the application program interface is a default resolution of the application program interface. For example, the predetermined resolution is selected from at least two predetermined selectable resolutions, and the default resolution may be a physical resolution of the display device or a predetermined resolution smaller than the physical resolution of the display device.

The AMS obtains corresponding configuration information according to the determined appropriate resolution, and the WindowManagerService (WMS) establishes a display window having a size equal to the size corresponding to the appropriate resolution according to the configuration information, and loads a resource file corresponding to the configuration information through the ResourceManager.

WMS further feeds back the size of the established display window to the application program, such that the application program performs re-calculation to refresh the layout of a layout file included after receiving the size information of the display window.

Surfaceflinger obtains a currently displayable layer during handleMessageRefresh, and calculates a transform matrix according to the size of the corresponding window established by WMS, so as to render the layer to the frame buffer. For example, when SurfaceFlinger obtains the currently displayable layer and determines that the resolution corresponding to the layer (the appropriate resolution) is smaller than the physical resolution, SurfaceFlinger changes the transform matrix of the layer to control the layer to be rendered in an upper-left corner region of the frame buffer; when SurfaceFlinger obtains the currently displayable layer and determines that the resolution corresponding to the layer (the appropriate resolution) is equal to the physical resolution, SurfaceFlinger changes the transform matrix of the layer to control the layer to be rendered in an entire region of the frame buffer. Through adjusting sizes of source and destination of StretchWindow of GOP, the size of the rendered application program interface is adjusted to be equal to the size corresponding to the physical resolution, and the rendered application program interface is then displayed on the display device.

Further, when the number of application programs to be executed is in plural, as previously described, the appropriate resolution of each of the application programs is determined and a display window having a size equal to the size corresponding to each of the appropriate resolutions is established, and the interface rendering unit 54 utilizes the maximum of the multiple appropriate resolutions as a final resolution for each of the application programs to be executed. For example, assume the appropriate resolution of a first application program interface is 3840×210, the appropriate resolution of a second application program interface is 1920×1080, and the appropriate resolution of a third application program interface is 1920×1080. The interface rendering unit 54 utilizes 3840×2160 as the resolution of the first, second and third application programs, and renders the corresponding application program interface for each of the display windows according to the 3840×2160 resolution and the resource file.

In conclusion, the present invention provides a display control method and device for an application program interface. The display control method and device determine an appropriate resolution according to related information of an application program to be executed (e.g., an attribute of an application program interface), and establishes a display window having a size equal to a size corresponding to the resolution according to determined configuration information of the resolution to render the application program interface in the display window. Instead of activating different applications under one same resolution, the size and layout of the display window for each application program interface can be correspondingly adjusted after selecting an appropriate resolution. Thus, the technical issue of blurring that is caused by stretching a low-resolution application program interface in a high-resolution device is eliminated. Meanwhile, a lower and appropriate resolution is selected in a high-resolution device to display an application program interface having a lower resolution, thereby achieving a technical effect of saving resources of a graphic processor.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display control method for an application program interface, for controlling and displaying the application program interface on a display device, the display control method comprising:

determining an appropriate resolution corresponding to an application program interface to be executed from at least two predetermined selectable resolutions by:

determining whether the application program is in a white list, wherein the white list is established in advance and records a list of application programs having the appropriate resolution as a predetermined resolution, and the predetermined resolution is selected from the at least two predetermined selectable resolutions; and determining that the appropriate resolution is the predetermined resolution when it is determined that the application program is in the white list;

determining corresponding configuration information according to the appropriate resolution;

establishing a display window having a size equal to a size corresponding to the appropriate resolution according to the configuration information, and loading a resource file corresponding to the application program interface; and rendering the application program interface in the display window on the display device according to the appropriate resolution and the resource file.

2. The display control method according to claim 1, wherein the step of determining the appropriate resolution corresponding to the application program to be executed from at least two predetermined selectable resolutions comprises:

determining the appropriate resolution of the application program interface according to an attribute of the application program interface, wherein a corresponding relationship between the attribute of the application program interface and the appropriate resolution is established in advance.

3. The display control method according to claim 1, wherein the step of determining the appropriate resolution corresponding to the application program to be executed from at least two predetermined selectable resolutions further comprises:

determining that the appropriate resolution is a default resolution of the application program interface when it is determined that the appropriate resolution is not the predetermined resolution; the default resolution is a physical resolution of the display device, or a resolution smaller than the physical resolution of the display device.

4. The display control method according to claim 1, wherein the appropriate resolution is smaller than a physical resolution of the display device.

5. The display control method according to claim 4, wherein the step of rendering the application program interface in the display window on the display device according to the appropriate resolution and the resource file comprises:

sending a size of the display window to the application program to perform a layout process on an interface of the application program; and rendering the display window in an upper-left corner region of a frame buffer of the display device according to the appropriate resolution and the loaded resource file, and rendering the application program interface of the application program having undergone the layout process in the display window.

6. The display control method according to claim 1, wherein the appropriate resolution is equal to a physical resolution of the display device.

7. The display control method according to claim 6, wherein the step of rendering the application program interface in the display window on the display device according to the appropriate resolution and the resource file comprises:

sending a size of the display window to the application program to perform a layout process on an interface of the application program; and rendering the display window in an entire region of a frame buffer of the display device according to the appropriate resolution and the loaded resource file, and rendering the application program interface of the application program having undergone the layout process in the display window.

8. The display control method according to claim 1, after the step of rendering the application program interface in the display window on the display device according to the appropriate resolution and the resource file, the method further comprising:

adjusting a size of the rendered application program interface to be equal to a size corresponding to physical resolution of the display device.

9. A display control device for an application program interface, for controlling and displaying the application program interface on a display device, the display control device comprising:

a white list establishing unit, configured to establish a white list in advance and to record a list of application programs having a corresponding appropriate resolution as a predetermined resolution, wherein the predetermined resolution is selected from at least two predetermined selectable resolutions;

a resolution determining unit, configured to:

determine an appropriate resolution corresponding to an interface of an application program to be executed from the at least two predetermined selectable resolutions; and determine whether the application program to be executed is in the white list according to the white list established by the white list establishing unit;

a configuration information determining unit, configured to determine corresponding configuration information according to the appropriate resolution determined by the resolution determining unit;

a display window establishing unit, configured to establish a display window having a size equal to a size corresponding to the appropriate resolution according to the configuration information determined by the configuration information determining unit, and loading a resource file corresponding to the application program interface; and an interface rendering unit, configured to render the application program interface in the display window on the display device according to the appropriate resolution and the resource file.

10. The display control device according to claim 9, wherein the resolution determining unit sets a corresponding relationship between an attribute of the application program interface and the appropriate resolution in advance, and determines the appropriate resolution of the application program interface according to the attribute of the application program to be executed; the attribute of the application program is identifiable according to a function to be performed, or identifiable according to a name of the application program.

11. The display control device according to claim 9, further comprising:

the resolution determining unit determines that the appropriate resolution is the predetermined resolution when it is determined that the application program is in the white list, and determines that the appropriate resolution is a default resolution of the application program interface when it is determined that the appropriate resolution is not the predetermined resolution; the default resolution is a physical resolution of the display device, or a resolution smaller than the physical resolution of the display device.

12. The display control device according to claim 9, further comprising:

an interface adjusting unit, configured to adjust a size of the application program interface rendered by the interface rendering unit to be equal to a size corresponding to physical resolution of the display device.

13. A display control method for an application program interface, for controlling and displaying the application program interface on a display device, the display control method comprising:

determining an appropriate resolution corresponding to an application program interface to be executed from at least two predetermined selectable resolutions by:

determining whether the application program is in a white list, wherein the white list is established in advance and records a list of application programs having the appropriate resolution as a predetermined resolution, and the predetermined resolution is selected from the at least two predetermined selectable resolutions;

determining that the appropriate resolution is the predetermined resolution when it is determined that the application program is in the white list;

determining that the appropriate resolution is a default resolution of the application program interface when it is determined that the appropriate resolution is not the predetermined resolution; the default resolution is a physical resolution of the display device, or a resolution smaller than the physical resolution of the display device; and determining corresponding configuration information according to the appropriate resolution;

establishing a display window having a size equal to a size corresponding to the appropriate resolution according to the configuration information, and loading a resource file corresponding to the application program interface; and rendering the application program interface in the display window on the display device according to the appropriate resolution and the resource file.

* * * * *